US007204066B2

(12) United States Patent
Monti

(10) Patent No.: US 7,204,066 B2
(45) Date of Patent: Apr. 17, 2007

(54) DEVICE FOR SCREWING CAPS ONTO BOTTLES OR SIMILAR CONTAINERS

(75) Inventor: Guiseppe Monti, Pianoro (IT)

(73) Assignee: Tonazzi Vasquali S.r.l., Milan (IT)

( * ) Notice: Subject to any disclaimer, the term of this patent is extended or adjusted under 35 U.S.C. 154(b) by 0 days.

(21) Appl. No.: 11/132,927

(22) Filed: May 19, 2005

(65) Prior Publication Data

US 2005/0229540 A1 Oct. 20, 2005

(30) Foreign Application Priority Data

May 20, 2004 (IT) ..... BO04A0325

(51) Int. Cl.
*B67B 3/20* (2006.01)

(52) U.S. Cl. ..... 53/287; 53/317

(58) Field of Classification Search ..... 53/285, 53/287, 301, 317, 329, 331.5, 476, 485
See application file for complete search history.

(56) References Cited

U.S. PATENT DOCUMENTS 1,598,392 A * 8/1926 Risser ..... 53/331.5
2,106,365 A * 1/1938 Tiano ..... 53/317
2,359,932 A * 10/1944 Newey ..... 53/201
2,744,368 A * 5/1956 Everett ..... 53/67
2,819,577 A 1/1958 Dimond
3,440,798 A 4/1969 Rackley
3,530,637 A * 9/1970 Rezner et al. ..... 53/488
4,559,759 A 12/1985 Herbert
5,417,031 A * 5/1995 Bankuty et al. ..... 53/331.5
5,419,094 A * 5/1995 Vander Bush et al. ..... 53/75
5,996,311 A * 12/1999 Heard et al. ..... 53/317

FOREIGN PATENT DOCUMENTS

CH 637 600 8/1983

* cited by examiner

*Primary Examiner*—Stephen F. Gerrity
*Assistant Examiner*—Paul Durand
(74) *Attorney, Agent, or Firm*—William J. Sapone; Coleman Sudol Sapone P.C.

(57) ABSTRACT

Device for screwing caps onto bottles and similar containers includes a work station, which supports a device for gripping the caps and which moves toward and away from the bottles, carried by a relative feeding line. An actuator, associated to the work station, drives the gripping device into rotation, so as to screw the caps onto the corresponding open heads of the bottles. A fricton device for coupling of the actuator with the gripping device, is operated in step relation with the positioning of the caps close to the open heads of the bottles.

9 Claims, 4 Drawing Sheets

DEVICE FOR SCREWING CAPS ONTO BOTTLES OR SIMILAR CONTAINERS

FIELD OF THE INVENTION

The present invention relates to machines for screwing caps onto corresponding bottles.

At present, the machines for screwing caps onto bottles or similar containers use mechanical systems, including springs or friction systems.

BACKGROUND OF THE INVENTION

These mechanical devices include two shafts, arranged in coaxial relation with each other as splined shafts with various shapes, one connected to gripping means, the other kept pushed against the first one, against the action of elastic means and driven into rotation by a motor.

During tightening of a cap, gripped by said gripping means, onto a corresponding bottle, the motor is operated and the just defined group moves with a rotation-translation motion, until the cap is completely screwed.

The transmission of the torque between the two shafts, and thus of the rotary motion, is assured by the friction coupling, which occurs between the corresponding splined profiles and which depends not only on the profiles shapes and contact surface, but also on the material, from which they are made and on the mutual pressure characterizing their contact.

In conditions of normal operation of the motor, that is when the cap is screwed on the corresponding threading in a regular way, a prefixed torque is transmitted to the driven shaft, so as to cause, in this order, a rotation of the latter by a prefixed angular pitch and a determined tightening of the cap.

When the screwing is jeopardized, for example, by mechanical inconsistencies of the two kinematic elements in question, the motor delivers a higher torque with respect to the prefixed one, putting at risk the coupling and the integrity of the gripping means.

The above described friction coupling imposes an upper limit to the maximum transmittable torque, which will be calculated in such a way, as to keep safe the gripping means, the cap and the threading, on which the cap is to be screwed: consequently, if the resisting torque value goes beyond the above mentioned limit value, the two connecting shafts slip one with respect to the other.

However, the elastic means aimed at transmitting the motion and at defining the "maximum transmittable torque" of the above mentioned mechanical devices, must be adjusted periodically because the mechanical features of these latter decay gradually with time.

Otherwise, as it has already been said, friction systems are used, which generally have also a friction coupling between the gripping means and the cap to be screwed onto the open head of a corresponding bottle; the added friction device comes into operation only in anomalous conditions, when the screwing step becomes irregular and the applied torque reaches or exceeds the allowed maximum value, this way causing the slipping of the gripping means on the cap.

Also in this case, the maximum allowed torque must be valued on the ground of the coupling characterizing the gripping means and the cap gripped by the latter.

Therefore, if the type and/or dimensions are to be changed, it is necessary to verify whether the new maximum torque value damages, if reached, the physical integrity of the cap and of the threading of the bottle, onto which the cap is screwed.

In some cases, the above described mechanical and friction systems can be provided with torque limiting devices, associated to the power means, so as to intervene during the tightening of the cap on the corresponding bottle, when the preset torque value is reached; in this way, the slipping of the connecting shafts, in one case, and the slipping of the friction means on the cap, in the other, occur only in isolated and accidental cases, when the limiting devices do not operate properly.

SUMMARY OF THE INVENTION

The object of the present invention is to propose a device, which can screw caps on corresponding bottles, applying a torque, which is not higher than a maximum prefixed value.

Another object of the present invention is to propose a device, which can apply the above torque to screw caps on corresponding bottles, independently from the geometrical and mechanical features of the cap and the relative threading.

A further object of the present invention is to propose a device, which not only satisfies the above objects, but whose form allows it to be installed in an automatic machine for filling bottles with prefixed products and for closing the bottles with relative caps.

The above mentioned objects are obtained, in accordance with the contents of the claims, by a device for screwing caps onto bottles or similar containers, the device including:

a work station for supporting gripping means for gripping said caps and moving toward and away from said bottles or similar containers;

a feeding line for carrying said caps to said work station;

actuator means, associated to said work station for driving said gripping means into rotation, so as to screw said caps onto corresponding open heads of the bottles;

working means capable of friction connecting said actuator means with said gripping means, operated in step relation with the positioning of the caps close to the open heads of the bottles.

BRIEF DESCRIPTION OF THE DRAWINGS

The characteristic features of the invention will be pointed out in the following description of some preferred but not limiting embodiments, with reference to the enclosed figures, in which.

DISCLOSURE OF THE PREFERRED EMBODIMENT

Figure 3A:
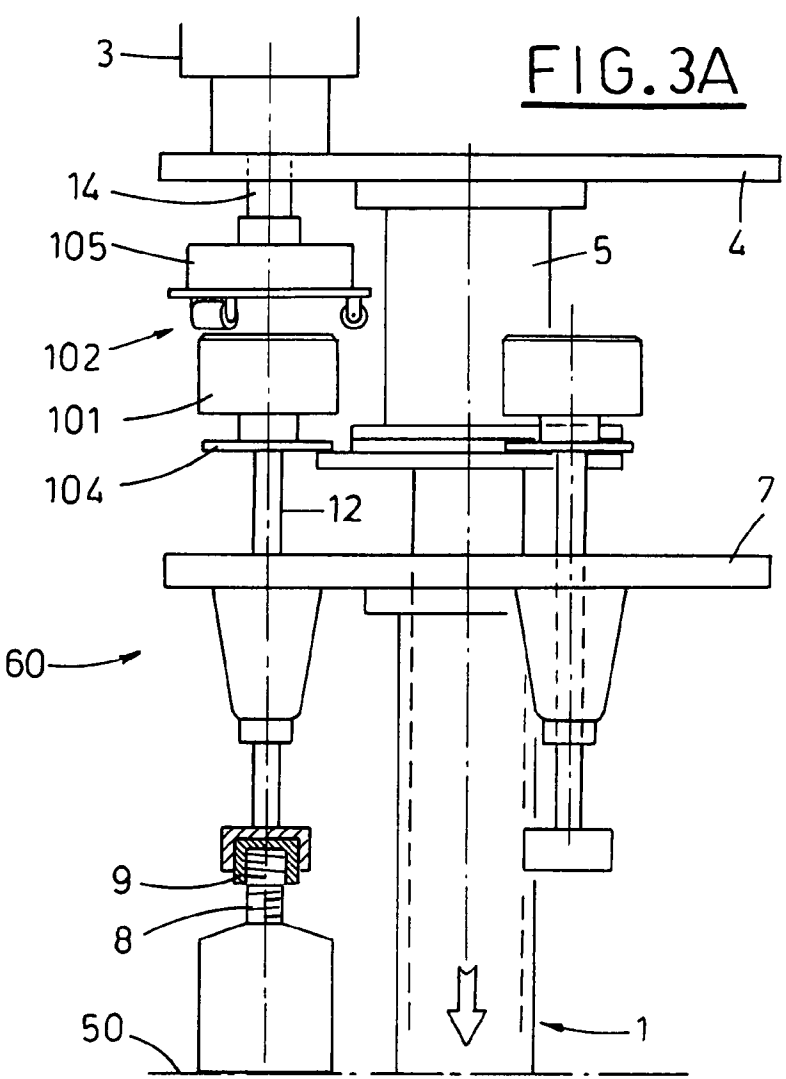
FIGS. 3A, 3B, 3C, 3D, 3E are schematic views of the front part of a machine for screwing caps on corresponding bottles, in working steps following the one shown in FIG. 1.

Regards the enclosed Figures, the reference numeral 50 indicates a feeding line of known type, on which bottles 10 are conveyed with the corresponding heads 8 open and regularly spaced apart by a prefixed step.

The reference numeral 1 indicates a working structure, which is moved vertically, close to and far from the bottles 10, by actuating means, not shown.

The working structure defines the machine for screwing caps on corresponding bottles 10, therefore, the following description will point out the construction aspects of the latter.

A tubular shaft 13, vertical and with circular section, supports, with its upper end, a rotary plate 7, coaxial therewith and having a circular through hole, which allows the prismatic coupling of a stem 5 with the rotary plate 7 and with the tubular element 13.

Figure 1:
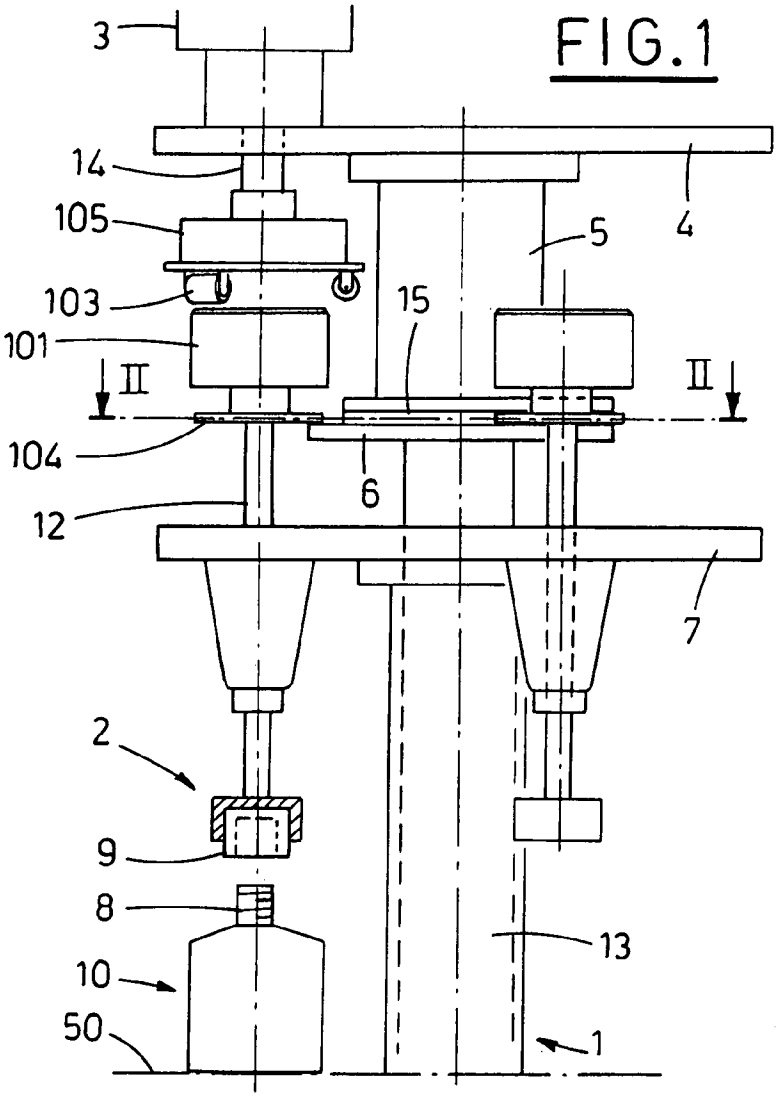
FIG. 1 is a schematic view of the front part of a machine for screwing caps on corresponding bottles, to which a determined working step corresponds.

The rotary plate 7, operated by the power means, not shown, has other through holes, for example three, equidistant from the center and arranged at 120° one with respect to another, engaging with as many shafts 12 in prismatic and turning coupling, as schematically shown in FIG. 1, where only two shafts 12 have been shown for sake of simplicity.

At their lower ends, the shafts 12 carry gripping means 2 and at their upper end, they carry a drum 101, below which a collar 104 is keyed to define a group 60.

The drum and the collar are coaxial with the shaft 12.

The stem 5, as it has been pointed out, engages partially, with a prismatic connection, with the group formed by the tubular element 13 and the rotary plate 7 and operated by means, which are not shown in the enclosed figures.

The stem carries, keyed thereon, a disc 6, which forms a circumferential groove 15 situated in correspondence to the transversal symmetry plane of the disc, so as to maintain intact the symmetry condition with respect to this plane.

Figure 2:
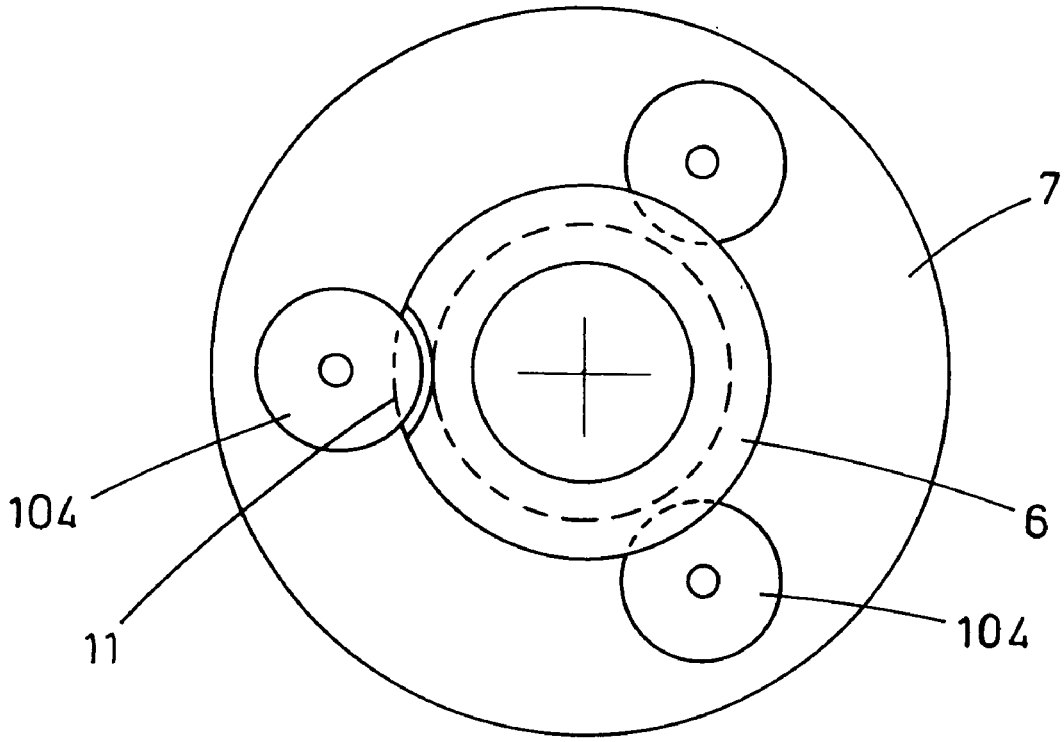
FIG. 2 is a schematic, enlarged view of the section II—II of FIG. 1.
Figure 4:
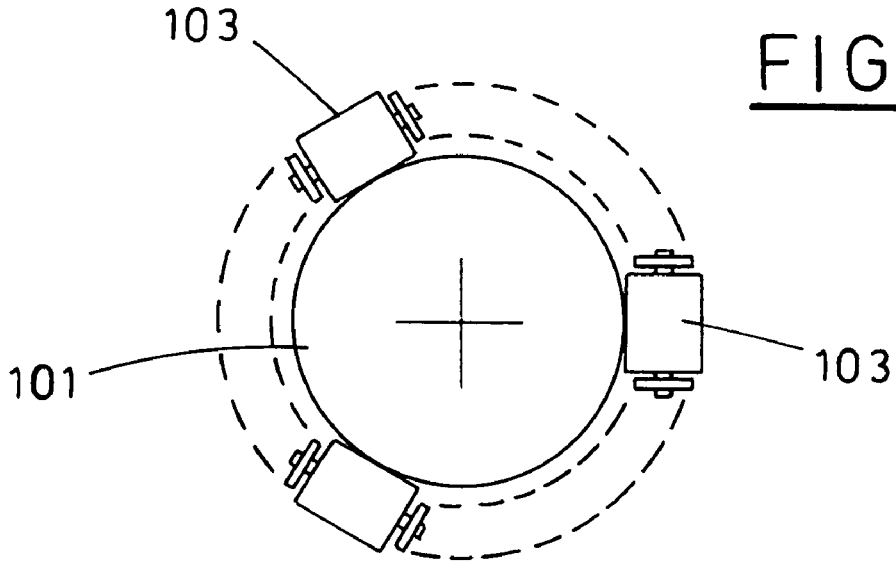
FIG. 4 is a schematic, enlarged view of the section IV—IV of FIG. 3B.

The symmetry is compromised by a recess made on the upper part of the disc 6 and forming a circumference arc, as seen in FIG. 2, so as to define a removable coupling between a portion of the collar 4 and a protrusion 11, formed by the lower part of the disc 6 and in a region corresponding to the recess.

In particular, the protrusion 11 intercepts the portion of the collar 104 during the stem 5 raising by the means for the vertical operation of the latter, and disengages therefrom during the lowering step.

The remaining two groups 60, each of which is formed by said shaft 12, gripping means 2, drum 101 and collar 104, are prevented from sliding with respect to the stem 5, due to the coupling between the collar 104 of each group 60 and the groove 15 made in the disc 6.

A platform 4, keyed onto the upper end of the stem 5, has a through hole, which engages in turning coupling with a transmission shaft 14, transmitting the rotating motion imposed by an actuator element 3, supported by the same platform 4, to an element 105, forming a bell-like member, as shown in FIG. 1.

It is to be specified that the distance between the axis of the shaft 14 and the axis of the stem 5 is equal to the distance between the latter and the axis of the shaft 12, which carries the gripping means 2.

Three rollers 103, angularly equidistant, are mounted at the lower edge of the bell-like member 105, to operate tangentially with respect to the lateral surface of the drum 101, so as to interfere therewith by friction tangentially, and to rotate thereon longitudinally.

The group formed by the bell-like member 105 and the rollers 103 define friction means 102.

The interference between the drum 101 and the rollers 103 is such, as to define a transmittable torque higher, e.g. than the maximum torque, which can be delivered by the actuator element 3.

Torque limiting means (not shown) are connected to the actuator element 3 to limit the value of the transmittable torque during the cap tightening.

Now the operation of the proposed device for screwing caps on corresponding bottles will be described.

As it has been specified, the work station 1 defines a machine for screwing caps on corresponding bottles, operating in accordance with a certain number of steps following each other cyclically, shown schematically in FIGS. 1, 3A, 3B, 3C, 3D, 3E.

Taking into consideration the working step shown in FIG. 1, the group 60 is in alignment with the bottle 10: the work station 1 performs a vertical translation downwards, aimed at, according to known techniques, bringing the cap 9, connected to the gripping means 2, to touch the working head 8 of the bottle 10, motionless on the feeding line 50.

Figure 3C:
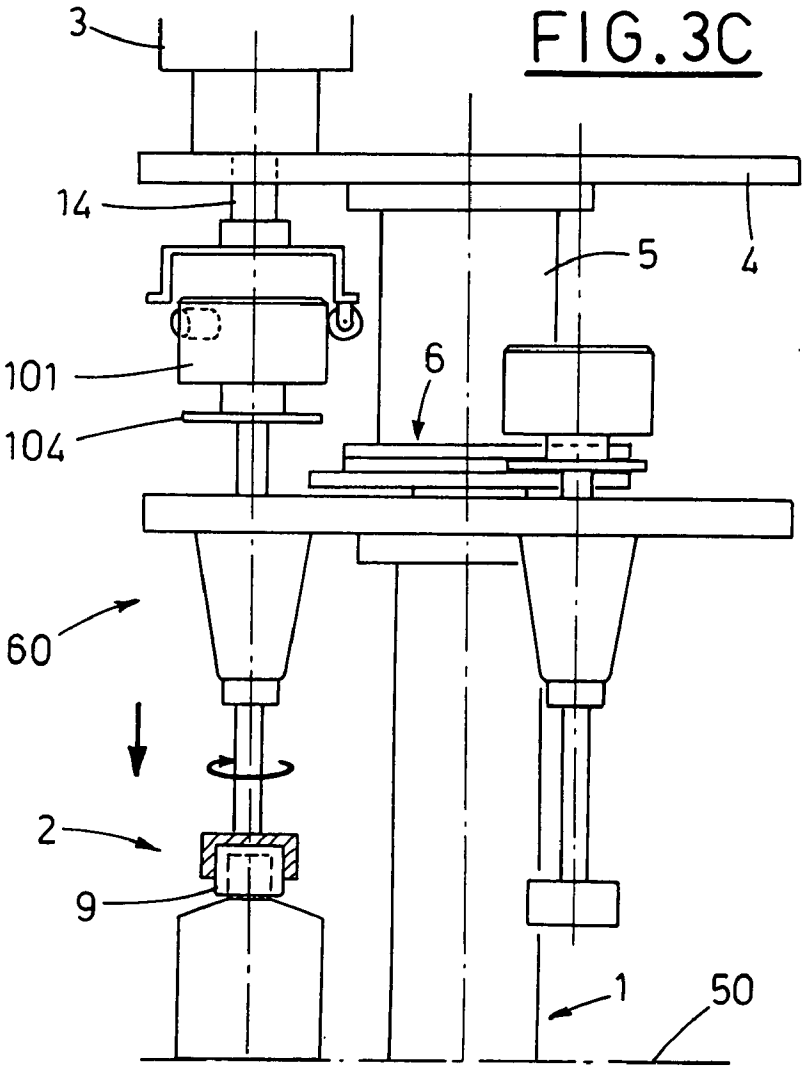
Figure 3B:
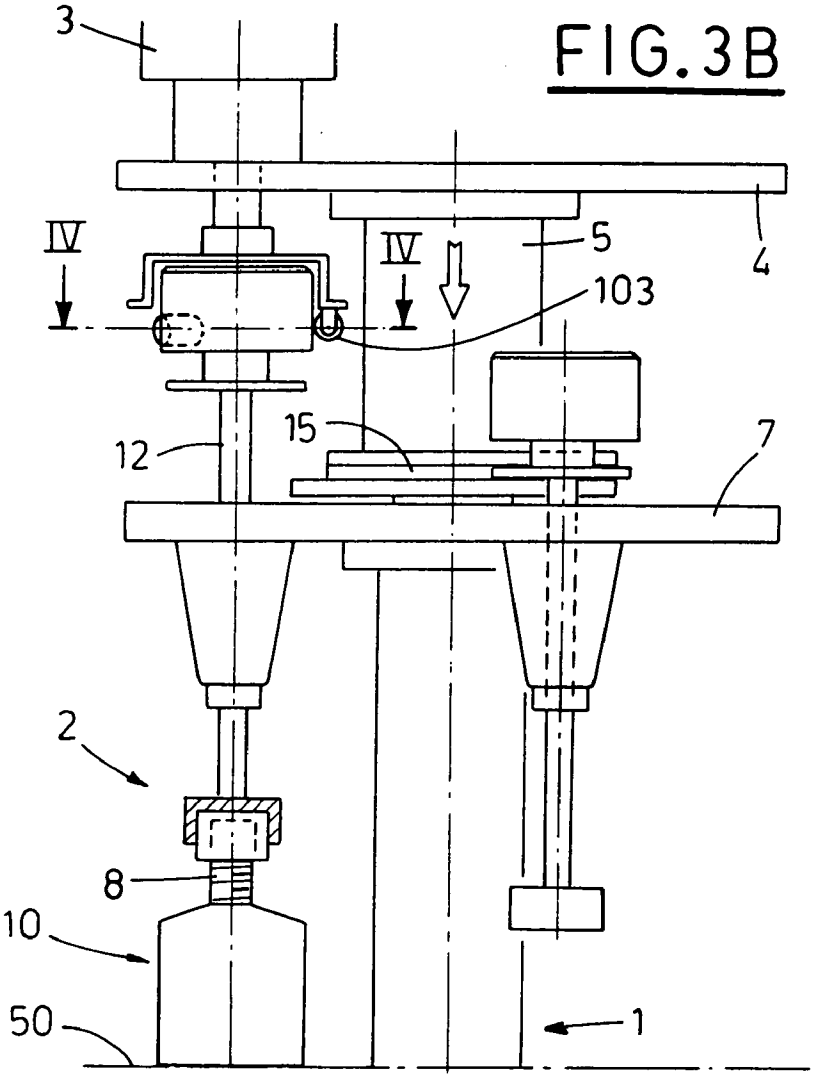

Afterwards, the stem 5 is lowered, as it is seen in FIG. 3B, by the relative axial operation means.

This operation determines, at the same time, the disengaging of the protrusion 11 from the collar 104, the lowering of the above mentioned groups 60, whose drum is not engaged with the friction means 102, and the lowering of the bell-like member 105 carrying the rollers 103, so that the latter slide longitudinally on the lateral surface of the drum 101 by a length at least equal to the number of steps, which the cap 9 must perform during the screwing on the open head 8.

Afterwards, see FIGS. 3B and 3C, the actuator means 3 set the bell-like member 105 in a determined angular rotation by the friction caused by the interference between the rollers 103 and the lateral surface of the drum 101; this coupling causes the setting in rotation of the drum 101, and thus of the gripping means 2, which screw the cap 9 onto the open head 8.

Consequently, the group 60 moves downward in a rotation-translation way, and its vertical translation is caused by the coupling of the cap 9 with the open head 8.

During the screwing, the actuator element 3 delivers a torque, which is entirely transmitted to the driven shaft 12 and consequently, to the gripping means 2, screwing the cap onto the corresponding threading of the open head 8.

The cap is blocked when it is completely screwed onto the corresponding threading made in the open head 8 and the actuator 3 performs a tightening action until a prefixed torque is reached.

This torque value is limited by the associated limiting device, which controls also, by suitable associated sensor means, if a given total rotation of the cap has occurred.

In anomalous conditions, a resisting torque can occur between the cap and the corresponding threading, such that the actuator element 3 must deliver a torque higher that the prefixed one before the tightening step is completed.

The limiting devices will find and cope with the error state caused by a rotation of the cap, incomplete with respect to the specifics.

Figure 3E:
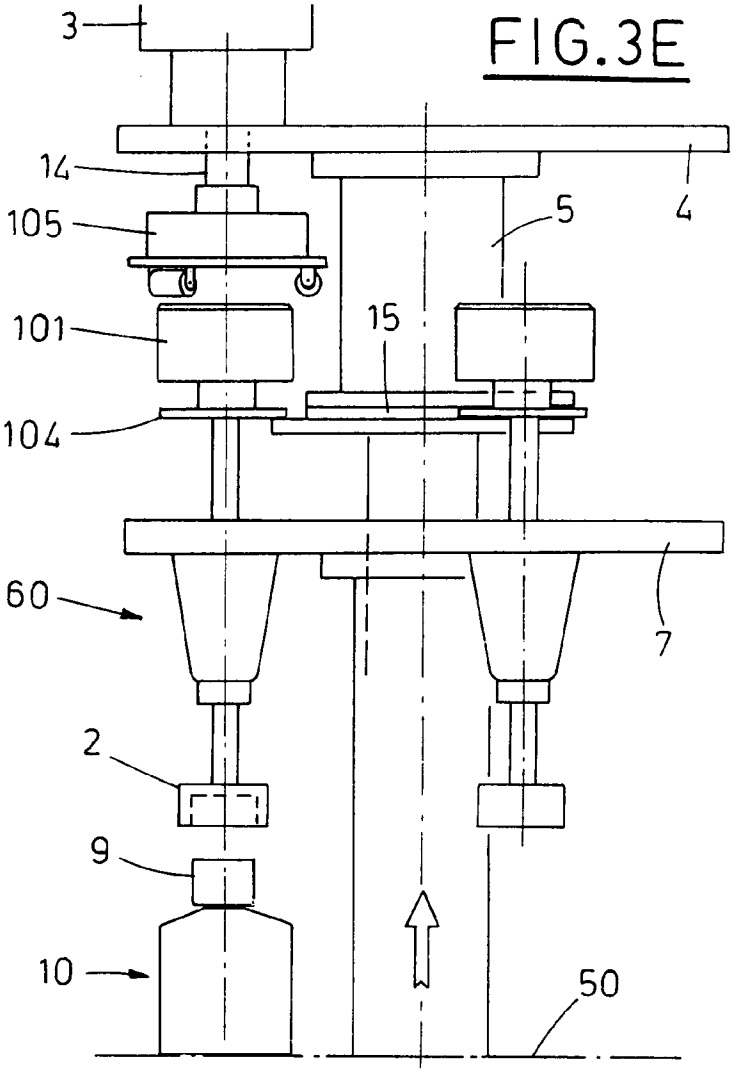
Figure 3D:
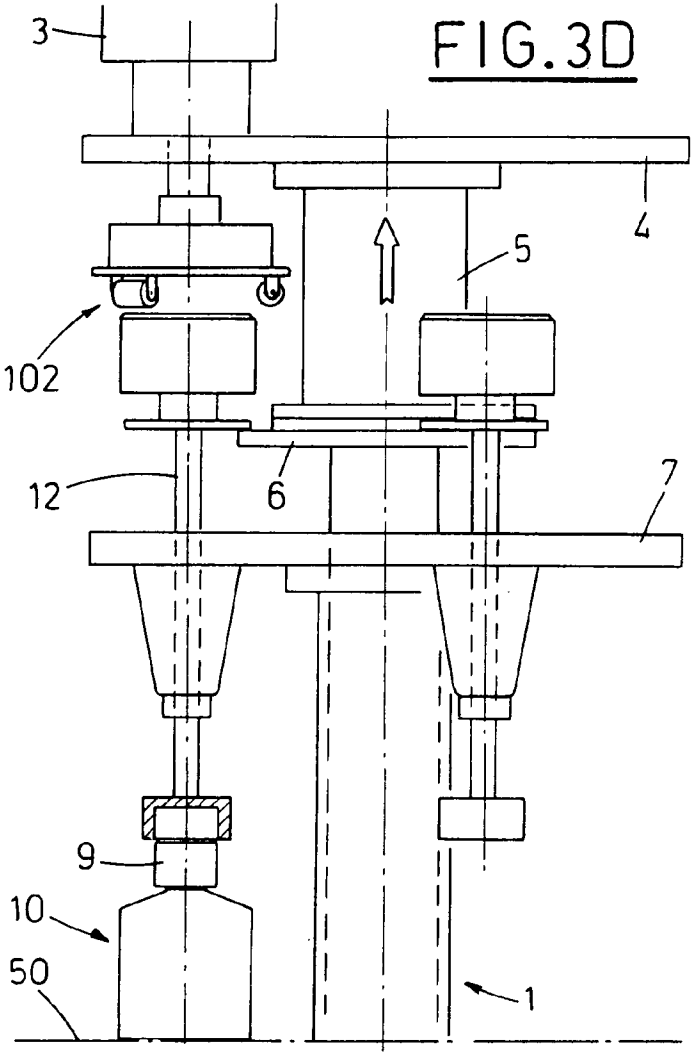

After the screwing of the caps 9 has been completed, the work station 1 translates upwards in suitable step relation, FIG. 3D, as well as the stem 5, FIG. 3E, until the friction means 102 disengage from the drum 101.

At this point, the rotary plate 7 is made rotate by an angular pitch of 120°, in this case, thus causing the axial alignment of a subsequent group 60, whose gripping means 2 carry another cap 9 to be screwed onto the open head 8 of a subsequent bottle 10.

This operation is shown in FIG. 1, with the machine for screwing caps onto corresponding bottles, having completed a whole working cycle.

Consequently, the obtained device is simple in its structure, but it assures, in its simplicity, the application of a prefixed torque between the cap and the corresponding threading, independently from the shape, dimensions and material of these elements.

The versatility of the proposed device appears when the production needs require a modification, minimal or substantial, of the type of the coupling between the cap and corresponding gripping means, since the torque value prefixed for the tightening depends on the configuration of the limiting device, or in the given cases, on the dimensioning of the friction means 102.

Therefore, the bigger versatility resolves the problems of the present friction devices used in machines for screwing caps onto corresponding bottles.

It is understood that the proposed invention has been described, with reference to the enclosed figures, as a mere, not limiting example. Therefore, it is obvious that any changes or variants applied thereto remain within the protective scope defined by the following claims.

What is claimed is:

1. Device for screwing caps onto bottles, the device comprising:

a work station for supporting gripping means for gripping said caps and moving toward and away from said bottles;

a feeding line for carrying said caps to said work station;

actuator means, associated to said work station for driving said gripping means into rotation, so as to screw said caps onto corresponding open heads of the bottles;

working means capable of friction connecting said actuator means with said gripping means, operated in step relation with the positioning of the caps close to the open heads of the bottles, said working means including at least one drum, connected to said gripping means, and friction means, connected to said actuator means, interacting with said drum to transmit to the drum a torque, whose value is always higher than a torque generated by said actuator means.

2. Device, as claimed in claim 1, wherein said friction means include at least one roller carried by a bell-like member and operating tangentially with respect to a lateral surface of said drum, and acting tangentially, by friction, onto said lateral surface, and rotating on said lateral surface longitudinally, due to axial translation of said gripping means.

3. Device, as claimed in claim 1, wherein said friction means include at least three rollers, carried by a bell-like member and disposed angularly equidistant, operating tangentially to a lateral surface of said drum, so as to act therewith by tangential friction, and to rotate thereon longitudinally.

4. Device for screwing caps onto bottles, the device comprising:

a work station for supporting gripping means for gripping said caps and moving toward and away from said bottles;

a feeding line for carrying said caps to said work station;

actuator means, associated to said work station for driving said gripping means into rotation, so as to screw said caps onto corresponding open heads of the bottles;

working means capable of friction connecting said actuator means with said gripping means, operated in step relation with the positioning of the caps close to the open heads of the bottles, said working means including at least one drum, connected to said gripping means, and friction means, connected to said actuator means;

a rotary plate, rotating with respect to a vertical axis and operated stepwise, and carrying at least said gripping means and drum;

a vertical stem, extending above said rotary plate, coaxial therewith, and supporting a platform, which supports said actuator means and said friction means;

means for removably coupling said stem with a shaft supporting said drum; and means for axially moving said stem, operated in step relation with the activation of the work station.

5. Device, as claimed in claim 4, wherein said means for removable coupling include a protrusion, carried by said stem, and a collar, keyed onto said shaft, carrying said drum, with a portion of the collar being intercepted by the protrusion during raising of the stem by said means for axial moving said stem.

6. Device, as claimed in claim 5, further including at least two groups, each group formed by said gripping means, collar and drum, with said protrusion being formed by a disc, keyed onto said stem, which has a groove, engaging with the collar of the group, whose drum is not in engagement with said friction means.

7. Device, as claimed in claim 4, wherein an extent of the axial movement upwards of said stem is such as to cause a disengagement of said friction means from the drum.

8. Device, as claimed in claim 4, wherein said friction means include at least one roller carried by a bell-like member and operating tangentially with respect to a lateral surface of said drum, and acting tangentially, by friction, onto said lateral surface, and rotating on said lateral surface longitudinally, due to axial translation of said gripping means.

9. Device, as claimed in claim 4, wherein said friction means include at least three rollers, carried by a bell-like member and disposed angularly equidistant, operating tangentially to a lateral surface of said drum, so as to act therewith by tangential friction, and to rotate thereon longitudinally.

* * * * *